US005686174A

United States Patent [19]

Irrgeher

[11] Patent Number: 5,686,174

[45] Date of Patent: Nov. 11, 1997

[54] JOINT-SEALING STRIP

[75] Inventor: Fritz Irrgeher, Leverkusen, Germany

[73] Assignee: Illbruck GmbH, Leverkusen, Germany

[21] Appl. No.: 525,589

[22] PCT Filed: Mar. 7, 1994

[86] PCT No.: PCT/EP94/00675

§ 371 Date: Sep. 11, 1995

§ 102(e) Date: Sep. 11, 1995

[87] PCT Pub. No.: WO94/20701

PCT Pub. Date: Sep. 15, 1994

[30] Foreign Application Priority Data

Mar. 10, 1993 [DE] Germany ..... 43 07 528.2

[51] Int. Cl.[6] ..... C09K 3/10

[52] U.S. Cl. ..... 428/322.7; 428/304.4; 428/310.5; 428/313.5

[58] Field of Search ..... 428/322.7, 304.4, 428/310.5, 313.5

[56] References Cited

U.S. PATENT DOCUMENTS

| | | | |
|---|---|---|---|
| 4,401,716 | 8/1983 | Tschudin-Mahrer | 428/317.3 |
| 4,977,018 | 12/1990 | Irrgeher et al. | 428/314.4 |
| 4,996,092 | 2/1991 | Francis et al. | 428/157 |

FOREIGN PATENT DOCUMENTS

| | | |
|---|---|---|
| 072955 | 3/1983 | European Pat. Off. . |
| 229951 | 12/1986 | European Pat. Off. . |
| 317833 | 11/1988 | European Pat. Off. . |
| 323589 | 12/1988 | European Pat. Off. . |
| 1544724 | 9/1968 | France . |
| 477640 | 10/1969 | France . |
| 1000946 | 11/1958 | Germany . |
| 1166656 | 10/1969 | United Kingdom . |

*Primary Examiner*—Kathleen Choi
*Attorney, Agent, or Firm*—Collard & Roe, P.C.

[57] ABSTRACT

A joint-sealing strip is made of soft foam material, with an impregnation leading to delayed recovery. In order to obtain a simple structure combined with an advantageous design especially with respect to technical handling, the impregnation varies over the width of the joint-sealing strip, namely in a marginal longitudinal area. A strengthened impregnation is made preferably extending over the total thickness in the marginal longitudinal area, in such a manner that upon release of the recovery, a profile rising toward a longitudinal center line of the joint-sealing strip is obtained.

18 Claims, 3 Drawing Sheets

JOINT-SEALING STRIP

BACKGROUND OF THE INVENTION

1. Field of the Invention

The invention relates to a joint-sealing strip made of soft foam material, with an impregnation leading to delayed recovery.

2. The Prior Art

Such joint-sealing strips have become known in the prior art with various designs. First of all, reference is made, for example to French patent No. 1 544 724. In addition there is the German patent 1 000 946. Furthermore, such sealing strips have become known with various other designs as well, whereby reference is made in this regard to, for example EP-A-3 229 951, and to EP-A-2 323 589.

In order to obtain different properties for such a joint-sealing strip, but over the height of the joint-sealing strip, it has been proposed also in EP-A-1 317 833 to combine different foam materials, namely a foam material that can be impregnated with an impregnating medium, and a foam material that can not be impregnated with an impregnating medium.

Based on the above prior art, a problem is seen with respect to the invention in further developing a joint-sealing strip of the known type in such a way that an advantageous design is obtained especially under the aspect of technical handling, combined with a simple structure.

SUMMARY OF THE INVENTION

This problem is solved by the invention, whereby the objective is to obtain an impregnation that differs over the width of the joint-sealing strip, namely with a marginal longitudinal area. It is also an objective to obtain a strengthened impregnation preferably extending over the entire thickness of such marginal longitudinal area, in a way such that upon release of the recovery, a profile is obtained that rises toward the longitudinal center axis of the joint-sealing strip. It has been found that such an impregnation of the joint-sealing strip leads to an advantageous geometry of the joint-sealing strip before a compression is cancelled, for example by unwinding from a coil, and prior to the installation. This construction is significant, first of all, in connection with a conventional joint-sealing strip consisting of open-celled foam material and being impregnated for delayed recovery, as it is known from the literature specified above. In the present case, one marginal longitudinal area, or also both marginal longitudinal areas can be additionally strengthening, or preferably impregnated with a second impregnating medium, as described in greater detail in the following. Due to such additional strengthened or special impregnation, the foam material of the joint-sealing strip recovers in said area with delay also versus the center zone of the joint-sealing strip which, per, is already impregnated for delayed recovery. Basically, such delays readily may be in the range of 8, 16 or more hours (this is dependent also upon the ambient conditions such as the temperature, the humidity etc.). Furthermore, it is preferred that an impregnation particularly with the special impregnating medium specified in detail in the following, is carried out in one (or both) marginal longitudinal areas. Owing to the fact that the joint-sealing strip of this version is not impregnated elsewhere, the foam material of the joint-sealing strip consequently recovers there (i.e., in the center zone) directly and spontaneously upon release of the recovery. Consequently, such different recovery over the width of the joint-sealing strip also leads with said version to the geometric shape of a profile that rises toward the longitudinal center line of the joint-sealing strip. The foam material of the joint-sealing strip is, in this connection, selected uniformly: the impregnated marginal longitudinal area of the joint-sealing strip is formed by the same foam material as the unimpregnated area of the joint-sealing strip. Overall, the joint-sealing strip is formed by one integral strip of foam material. Furthermore, it is preferred also that an initial compression amounts to only about one third part up to half on the starting thickness of the foam material. This makes it possible also to use a foam material that, with respect to porosity, assumes a certain center position between the known open-pored foam material and a foam material with pores that are completely or approximately closed. Heretofore, the joint-sealing strips of the type assumed herein to be known have been manufactured only from open-pored foam materials. So that the impregnation can be produced in a through-extending way, it is even common to use reticulated open-pored foam material, so that a practically one hundred percent open porosity is obtained. As opposed to the above, it is preferred within the framework of the present invention that a foam material is used which, though substantially open-pored, consists of pores having, however, smaller inlet and outlet cross section, comparatively speaking versus an open-pored foam material of the type commonly used for such joint-sealing strips. In the present connection, however, the type of foam material used has to be selected less via the qualifying term "open-pored" or "closed pores", but rather must be characterized via its resistance to air. While the open-pored foam material (to which the invention relates as well, as stated in detail above) of the type normally used for such joint-sealing strips has an air resistance of about from 250 to 260 L.sq.m.s (measured according to DIN 53887), the foam material used for the version here under discussion has an air resistance of 30 to 60, preferably of from 40 to 50 L.sq.m.s (measured with a so-called Frank-instrument). The marginal longitudinal area, which is the only area having the impregnation, preferably corresponds with about one fourth part of the width of the joint-sealing strip. In another preferred embodiment, provision is made that the impregnation is produced in both marginal longitudinal areas, and that following the release of recovery, a center arching is obtained in the profile of the joint-sealing strip. Such geometric characterization at the same time contains also a statement with respect to the foam material used: the latter has to be suitably soft or flexible, so that the above profiling is set. In detail, the impregnation is made in both marginal longitudinal areas approximately over the same width, and in total across half of the width of the joint-sealing strip. With relatively wide joint-sealing strips, the width of the marginal longitudinal area may be relatively smaller. The impregnating medium as such, too, is preferably used in a special form. The use of impregnating media having a certain paraffin component is, admittedly, known. However, in connection with the present invention, it is preferred that the impregnating medium is selected practically purely based on paraffin. Furthermore, it is preferred also that so-called polywaxes are used (polyethylene glycols). The latter are adjustable with respect to their consistency from ointment-like to hard wax-like. In this way, it is possible also to control the delay of the recovery. Furthermore, the impregnating medium has certain modifying elements; however, such elements have hardly any bearing with respect to their share in the amount of the impregnating medium. With respect to the first version of the invention described in the foregoing, said last-described special impregnating medium may be "overimpregnated" in a simple way in the marginal areas, so that quasi a double layer of impregnating medium is obtained in said area. This is, incidentally, advantageous also with respect to further sealing of the pores (even if no complete closure is obtained), so that moisture can less readily penetrate (while, however, permeability to vapor is still assured to a certain degree). Furthermore, this has the advantage that joint-sealing strips produced in the conventional way will not have the stickiness usually found in the marginal areas provided with the special impregnating medium. This, too, advantageously supports the installation possibilities. Said advantage, of course, applies to the described second version in the same way.

Impregnation with the described special impregnating medium is significant also if it is not limited to one or both marginal longitudinal areas. Said special impregnating medium, or only said medium makes it possible to impregnate the described, herein preferred foam materials for delayed recovery. In any case, in regard to the described and preferably obtained special geometric features, it is possible also to obtain an embodiment in which an impregnation with the special impregnating medium is produced over the total surface, but with a lesser depth within the area of the center line.

BRIEF DESCRIPTION OF THE DRAWINGS

The invention is explained in greater detail in the following by reference to the attached drawing, which, however, only represents exemplified embodiments. In the drawing.

DETAILED DESCRIPTION OF PREFERRED EMBODIMENTS

Figure 2:
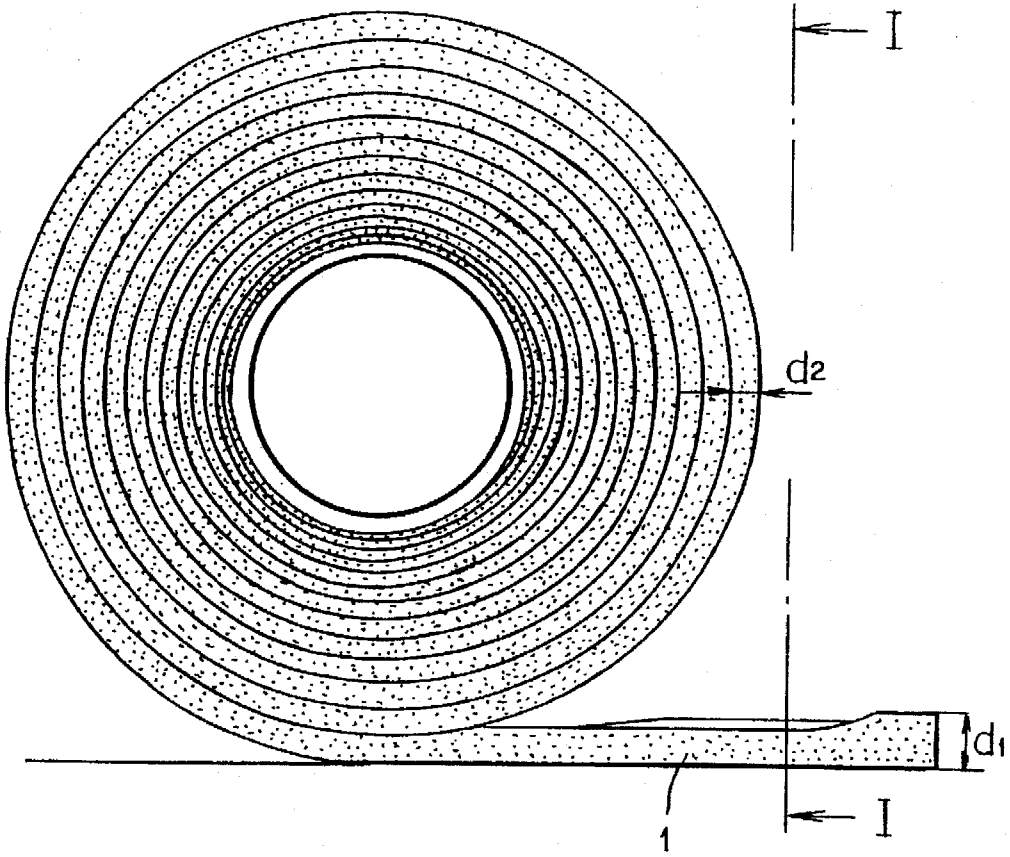
FIG. 2 shows a lateral view of the joint-sealing strip according to FIG. 1.
Figure 3:
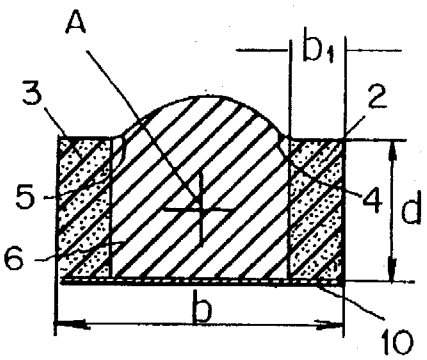
FIG. 3 shows an enlarged cross sectional view of the joint-sealing strip according to FIG. 1 or FIG. 2.
Figure 1:
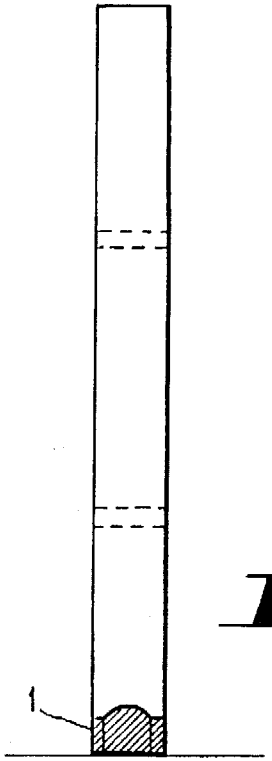
FIG. 1 shows a front view of a coil of joint-sealing strip material, with the loose leading end of the joint-sealing strip.

A joint-sealing, strip 1 is shown and described first with respect to FIGS. 1 to 3, such strip consisting of a soft, porous foam material, which is provided with an impregnation leading to delayed recovery. The impregnation is carried out based on polywax, which only contains a small component of modifying substances which, in terms of volume, have no bearing.

Of importance is that the impregnation is carried out in one marginal longitudinal area 2 or 3 of the joint-sealing strip. The cross section of the joint-sealing strip 1 shown in FIGS. 1 and 2 shows that the marginal longitudinal area 2 or 3 extends over the total thickness "d" of the joint-sealing strip 1, but not over the total width "b". In the exemplified embodiment, a width "b 1" of the—only—impregnated marginal longitudinal area 2 or 3 rather amounts to only about one fourth part of the total width "b" of the joint-sealing strip 1.

Furthermore, the cross-sectional representation according to FIG. 1 or FIG. 3 shows that following the release of recovery, a rising (flank 4 or 5) profile is obtained toward a longitudinal center line A (or the corresponding vertical longitudinal center plane), starting from a marginal longitudinal area 2 or 3.

In the embodiment according to FIGS. 1 to 3, in which provision is made for two impregnated marginal longitudinal areas 2, 3, an overall bell-shaped profile (in the upper zone) of the joint-sealing strip 1 is obtained shortly upon the release of recovery. A center zone 6 of the joint-sealing strip 1, which is not impregnated with an impregnating medium leading to delayed recovery, spontaneously recovers immediately upon the release of recovery. Therefore, the shown and described bell-like profile is obtained due to the fact that the marginal longitudinal areas 2, 3 did not recover.

It is important, furthermore, that a thickness "d1" of the completely recovered joint-sealing strip 1 (FIG. 2) amounts to only about two to three times the thickness "d2" of the joint-sealing strip 1 in the compressed state.

Figure 4:
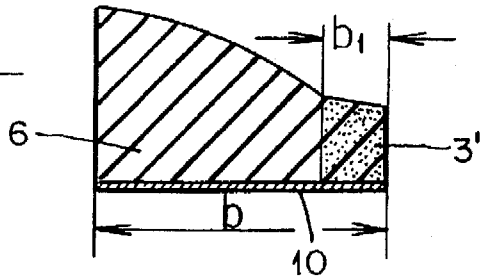
FIG. 4 shows an enlarged cross sectional view of a joint-sealing strip with unilateral impregnation of the marginal longitudinal area.

FIG. 4 shows the profile of a joint-sealing strip 1, in connection with which only one marginal longitudinal area 3' is provided with an impregnating medium leading to delayed recovery. Here, a profile is obtained that is, overall, substantially wedge-shaped.

Figure 5:
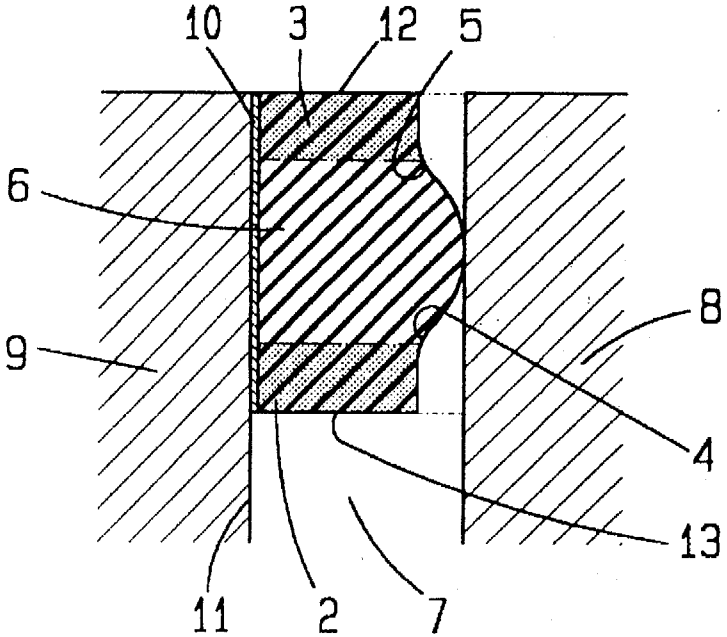
FIG. 5 shows a joint-sealing strip according to FIG. 3 in the installed condition.

In FIG. 5, the joint-sealing strip 1 according to the design according to FIGS. 1 to 3 is shown in the installed condition, whereby complete recovery of the impregnated marginal longitudinal areas 2, 3 has not yet occurred.

FIG. 5 shows that the recovery profile of the center zone 6 results with respect to installation in an advantageous first complete sealing of a joint 7 between two brickwork corner zones 8, 9 or the like. It shows, furthermore, that the joint-sealing strip 1 is provided on one of its surfaces of width with an adhesive tape 10, as it is known per se. In said exemplified embodiment, the joint-sealing strip 1 is glued to the one brickwork surface 11 of the brickwork corner zone 9 by means of the adhesive tape 10.

Following complete recovery of the joint-sealing strip 1 also in the marginal longitudinal areas 2, 3, an advantageous, quasi three-layer structure is obtained in the direction of thickness of the joint-sealing strip 1, i.e., from a top side 12 (in the installed condition) to a bottom side 13. Such a layered structure is important and advantageous under the aspect of construction physics as well. Higher tightness is obtained in the marginal longitudinal areas 2, 3, as well as very extensive closure of the pores of the foam material. On the other hand, a certain permeability including permeability to vapor remains available in the center area 6 of the joint-sealing strip 1. While a certain discharge of vapor from the interior of the sealed construction is still possible also through the brickwork 8—in the installed condition according to FIG. 4, such discharge from the inside quasi "bypassing" the lower marginal area 2, thus in the direction of the surface 12—, a quasi double barrier is obtained on account of the two marginal longitudinal areas 2, 3 with respect to penetration of moisture or vapor from the outside.

Furthermore, it is preferred that the impregnation of the two marginal longitudinal areas 2, 3 differs, in a way such that the marginal longitudinal area 3, the latter being arranged facing the outer side of a building in the installed condition, permits a diffusion of water vapor to a higher degree than the impregnation of the marginal longitudinal area 2 arranged facing the interior of the building in the installed condition. The same result can be achieved also by providing one (or both) marginal longitudinal areas 2, 3 with an impregnation in a different concentration, in a way such that the concentration of the outer surface 12 or 13 decreases toward a center zone 6 of the joint-sealing strip 1, whereby said measure may be implemented additionally as well.

Figure 6:
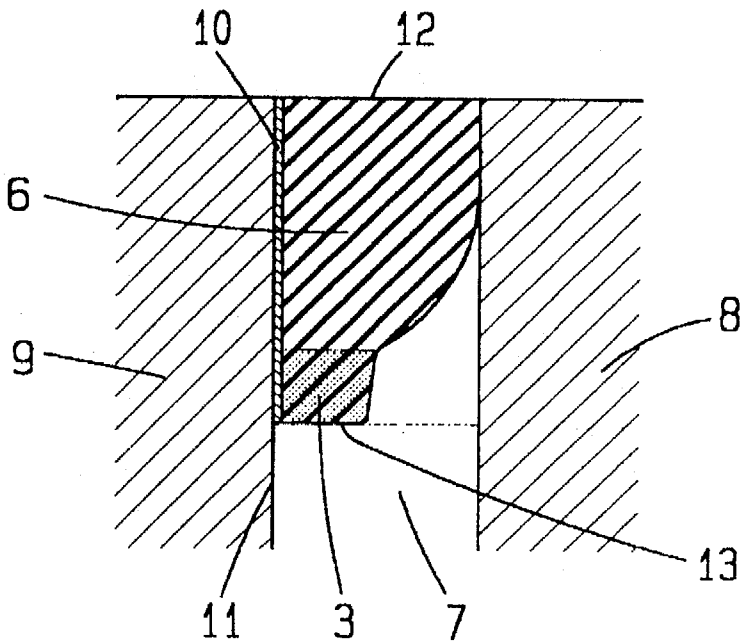
FIG. 6 shows a joint-sealing strip according to FIG. 4 in the installed condition.

FIG. 6 shows an installation clearance—also still shortly after the release of the delayed recovery—with respect to an only unilateral impregnation in a marginal longitudinal area or the joint-sealing strip 1.

Due to the wedge-shaped profile of the cross section, a very good installation possibility is obtained in this case as well.

FIGS. 5 and 6 each shown also by the shaded representation the nature of the surfaces 12 and 13 following complete recovery of the impregnated marginal longitudinal areas 2 and 3, respectively.

Especially polyurethane foam material is used as the foam material.

Figure 7:
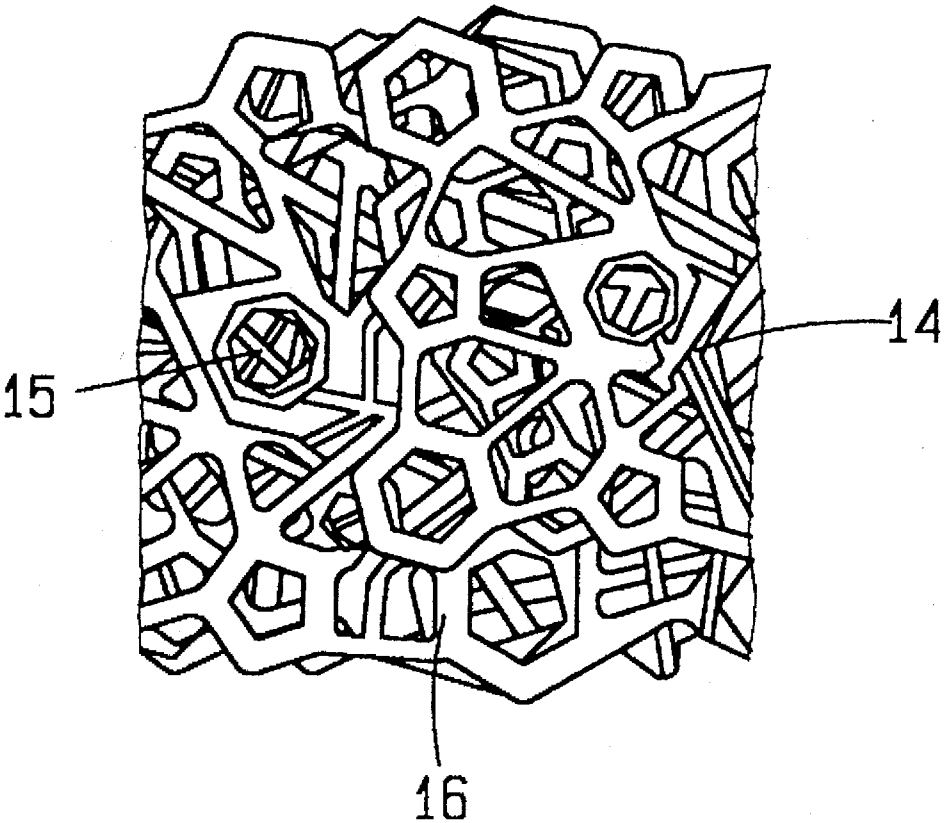
FIG. 7 shows a greatly enlarged representation of the foam material used.

FIG. 7 shows the structure of the polyurethane foam material used in the present case. The structure of the foam material, which is shown here slightly schematically for technical drawing reasons, consists of a net-like basic structure, in which the pores 14, 15, 16 etc. are present, such pores have larger or smaller openings. Although the cross sections of the openings of the pores are shown comparatively large, closure of the foam material is substantially obtained in fact also by the arrangement of very many layers of relatively small pores one on top of the other. For example, when simply blowing at the material, a passage of air through the latter can be accomplished only with great effort. This conforms to the measured technical value of about 40 to 50 L.sq.m.s specified in the foregoing.

The special impregnating medium used is advantageous in that it has an extremely low surface tension. Therefore, it already penetrates the marginal longitudinal areas during simple soaking. This may be of significance even in that the foam material may have a certain closed structure with a lesser percent proportion of open pores, because said special impregnating medium easily penetrates the foam material.

The above description of the exemplified embodiment is based on the assumption that a center area of the foam material is not impregnated at all. However, practically the same results are obtained if, as described in the foregoing for the first variation, a conventional joint-sealing strip—that is impregnated for delayed recovery in the conventional way as well—is additionally or in a special way impregnated in one or both marginal longitudinal area(s) 2, 3.

The features of the invention disclosed in the above specification, the drawing and in the claims may be significant to the realization of the invention both individually and in any desired combination. All disclosed features are significant to the invention. The content of the disclosure of the associated/attached priority documents (copy of the earlier application) is hereby included to its fullest extent in the disclosure of the present application.

I claim:

1. A joint-sealing strip comprising a soft, integral foam material, having an impregnation leading to delayed recovery, said sealing strip being a one-piece strip consisting of open-celled foam;

said joint-sealing strip having a width, and having a longitudinal centerline with a marginal longitudinal area on each side of said centerline; said marginal longitudinal area having a total thickness, and having a width;

said impregnation differing with a different concentration across the width of the joint-sealing strip, and a strengthened impregnation located in at least one marginal longitudinal area and extending up to the total thickness in said marginal longitudinal area, whereby the joint sealing strip shortly upon release from compression during the recovery and prior to the complete recovery is capable of having a rising profile toward the longitudinal center line of the joint-sealing strip.

2. Joint-strip according to claim 1, wherein an initial compression ranges from only about one third up to one half of a starting thickness of the joint-sealing strip.

3. Joint-sealing strip according to claim 1, wherein the marginal longitudinal area has about one fourth of the width of the joint-sealing strip.

4. Joint-sealing strip according to claim 1, wherein the impregnation is in both marginal longitudinal areas of the joint-sealing strip, and that upon release of the recovery, the profile of the joint-sealing strip has a center curvature.

5. Joint-sealing strip according to claim 1, wherein both marginal longitudinal areas are impregnated and both of said areas have the same width.

6. Joint-sealing strip according to claim 1, wherein there is the impregnation of the two marginal longitudinal areas, whereby the marginal longitudinal area arranged facing an outer side of a building in the installed condition, permits a diffusion of water vapor to a greater extent than the impregnation of the marginal longitudinal area arranged facing an interior of the building.

7. Joint-sealing strip according to claim 1, wherein said joint-sealing strip has outer surfaces and has a center zone; and wherein the impregnation of a marginal longitudinal area has a different concentration over the width of said marginal longitudinal area, whereby the concentration of the impregnation decreases from the outer surfaces toward a center zone of the joint-sealing strip.

8. Joint-sealing strip according to claim 1, wherein the foam material has a permeability to air of from 30 to 60 L.sq.m.s.

9. Joint-sealing strip according to claim 1, wherein the impregnation is a substance with a surface tension.

10. Joint-sealing strip comprising a soft, integral foam material, having an impregnation leading to delayed recovery, said sealing strip being a one piece strip consisting of open-celled foam; and said joint-sealing strip having a longitudinal centerline with a marginal longitudinal area on each side of said centerline; said joint-sealing strip having a width;

and the impregnation is only in the marginal longitudinal areas and with a different concentration across the width of the strip;

whereby the joint sealing strip shortly upon release from compression during the recovery and prior to the complete recovery is capable of having a rising profile toward a longitudinal center line of the joint-sealing strip.

11. Joint-sealing strip according to claim 10, wherein an initial compression ranges from only about one third up to one half of a starting thickness of the joint-sealing strip.

12. Joint-sealing strip according to claim 10, wherein the marginal longitudinal area has about one fourth of the width of the joint-sealing strip.

13. Joint-sealing strip according to claim 10, wherein the impregnation is in both marginal longitudinal areas of the joint-sealing strip, and that upon release of the recovery, the profile of the joint-sealing strip has a center curvature.

14. Joint-sealing strip according to claim 10, wherein both marginal longitudinal areas are impregnated and both of said areas have the same width.

15. Joint-sealing strip according to claim 10, wherein there is the impregnation of the two marginal longitudinal areas;

whereby the marginal longitudinal area arranged facing an outer side of a building in the installed condition, permits a diffusion of water vapor to a greater extent than the impregnation of the marginal longitudinal area arranged facing an interior of the building.

16. Joint-sealing strip according to claim 10, wherein said joint-sealing strip has outer surfaces and has a center zone; and wherein the impregnation of a marginal longitudinal area has a different concentration over the width of said marginal longitudinal area;

whereby the concentration of the impregnation decreases from the outer surfaces toward a center zone of the joint-sealing strip.

17. Joint-sealing strip according to claim 10, wherein the foam material has a permeability to air of from 30 to 60 L.sq.m.s.

18. Joint-sealing strip according to claim 10, wherein the impregnating medium is a substance with a surface tension.

* * * * *